US005537010A

United States Patent [19]

Johnson et al.

[11] Patent Number: 5,537,010

[45] Date of Patent: Jul. 16, 1996

[54] VOLTAGE-COMPARATOR, SOLID-STATE, CURRENT-SWITCH STARTER FOR FLUORESCENT LAMP

[75] Inventors: Samuel A. Johnson, Eagle; Dan E. Rothenbuhler, Meridian, both of Id.

[73] Assignee: Beacon Light Products, Inc., Meridian, Id.

[21] Appl. No.: 258,007

[22] Filed: Jun. 10, 1994

[51] Int. Cl.[6] ..... H05B 37/00

[52] U.S. Cl. ..... 315/289; 315/209 SC; 315/242; 315/307; 315/DIG. 5; 315/DIG. 7

[58] Field of Search ..... 315/289, 307, 315/283, 290, 242, 200 R, 209 SC, 276, DIG. 5, DIG 7

[56] References Cited

U.S. PATENT DOCUMENTS

| | | | |
|---|---|---|---|
| 3,265,930 | 8/1966 | Powell, Jr. | 315/209 |
| 3,422,309 | 1/1969 | Spira et al. | 315/194 |
| 3,707,648 | 12/1972 | Rosa | 315/231 |
| 3,851,209 | 11/1974 | Murakami et al. | 315/99 |
| 3,919,590 | 11/1975 | Remery et al. | 315/101 |
| 3,925,705 | 12/1975 | Elms et al. | 315/246 |
| 3,927,345 | 12/1975 | Licata et al. | 315/DIG. 5 |
| 3,935,505 | 1/1976 | Spiteri | 315/194 |
| 3,942,070 | 3/1976 | Tomura et al. | 315/101 |
| 4,087,723 | 5/1978 | Chermin et al. | 315/207 |
| 4,099,099 | 7/1978 | Grüdelbach | 315/194 |
| 4,107,579 | 8/1978 | Bodine, Jr. et al. | 315/205 |
| 4,119,887 | 10/1978 | Iyama et al. | 315/101 |
| 4,165,475 | 8/1979 | Pegg et al. | 315/99 |
| 4,181,872 | 1/1980 | Chermin | 315/106 |
| 4,329,627 | 5/1982 | Holmes | 315/209 R |
| 4,350,935 | 9/1982 | Spira et al. | 315/291 |
| 4,355,264 | 10/1982 | Merli | 315/289 |
| 4,447,759 | 5/1984 | Moerkens et al. | 315/60 |
| 4,507,569 | 3/1985 | Hess, II | 307/130 |
| 4,527,099 | 7/1985 | Capewell et al. | 315/291 |
| 4,649,323 | 3/1987 | Pearlman et al. | 315/307 |
| 4,651,060 | 3/1987 | Clark | 315/199 |
| 4,673,844 | 6/1987 | Maytum et al. | 315/200 R |
| 4,733,138 | 3/1988 | Pearlman et al. | 315/307 |
| 4,870,340 | 9/1989 | Kral | 323/235 |
| 4,899,088 | 2/1990 | Black, Jr. et al. | 315/291 |
| 5,004,960 | 4/1991 | Cockram et al. | 315/307 |
| 5,010,274 | 4/1991 | Phillips et al. | 315/101 |
| 5,030,890 | 7/1991 | Johnson | 315/208 |
| 5,055,746 | 10/1991 | Hu et al. | 315/291 |
| 5,111,115 | 5/1992 | Ball et al. | 315/239 |
| 5,221,877 | 6/1993 | Falk | 315/291 |
| 5,319,285 | 6/1994 | Wang et al. | 315/289 |
| 5,321,338 | 6/1994 | Nuckolls et al. | 315/290 |

OTHER PUBLICATIONS

Startlight TN22 Preliminary Data Sheet, *SGS–Thompson Microelectronics*, Nov., 1991, pp. 1/5–1/5.

*Primary Examiner*—Robert J. Pascal
*Assistant Examiner*—Haissa Philogene
*Attorney, Agent, or Firm*—John R. Ley

[57] ABSTRACT

A starter for a fluorescent lamp selectively conducts current from an AC power source through a ballast and cathodes of the lamp during one half cycle of conducted current from the AC power source. Thereafter and during the same on half cycle of current the starter ceases conducting current substantially instantaneously when the current is of a predetermined level. The resulting di/dt generates a starting voltage pulse from the ballast sufficient to ignite the plasma. The starting pulse occurs when the AC voltage across the cathodes exceeds an ignition voltage of the plasma. Preferably the starter employs a thyristor which has a predetermined holding current at least equal to the predetermined level to allow the inherent commutation of the thyristor to create the di/dt. The current conducted by the thyristor heats the cathodes prior to igniting the plasma. A voltage sensing capability associated with the starter triggers the thyristor into conduction only when the voltage across the cathodes exceeds the ignition voltage of the plasma, which occurs when the fluorescent lamp is not lighted, and therefore automatically starts the lamp. Lamp dimming and programmable turn on and turn off conditions are easily effected by timing an ignition and extinguishing sequence.

26 Claims, 5 Drawing Sheets

VOLTAGE-COMPARATOR, SOLID-STATE, CURRENT-SWITCH STARTER FOR FLUORESCENT LAMP

This invention relates to lighting, and more particularly a new and improved solid state starter for a fluorescent lamp which achieves reliable operation under conditions which were previously regarded as problematic. More particularly, the present invention relates to a solid state starter for a fluorescent lamp which makes advantageous use of a semiconductor thyristor or switch with a relatively high holding current to efficiently achieve improvements in lighting a fluorescent lamp.

CROSS REFERENCE TO RELATED APPLICATION

Information regarding the thyristor which is advantageously used in an embodiment of the present invention is discussed in a U.S. patent application for "High Temperature High Holding Current Semiconductor Thyristor", Ser. No. 08/257,899 filed concurrently herewith, and assigned to the Assignee hereof. The information relating to this thyristor is incorporated herein by this reference.

BACKGROUND OF THE INVENTION

The basic features of a typical and well known fluorescent lamp circuit, shown in FIG. 1, are important background information with respect to the present invention. A fluorescent lamp 10 is connected in series with a current limiting inductor known as a ballast 12. Conventional alternating current (AC) power from a source 14 is applied to the series connected lamp 10 and ballast 12. The fluorescent lamp 10 is formed generally of an evacuated translucent housing 16 which has two electrodes known as cathodes 18 placed at opposite ends of the housing 16. A small amount of mercury is contained within the evacuated housing 16. When the lamp 10 is lighted, an ionized plasma of vaporized mercury conducts power between the cathodes 18. Because of the high conductivity or low resistance characteristics of the mercury plasma, the ballast 12 is necessary to limit the current flow from the source 14 through the plasma, to prevent the cathodes 18 from burning out.

A starter 20 is connected between the cathodes 18. The function of the starter 20 is to light the lamp 10, which may prove difficult or impossible in certain circumstances. For example, the mercury inside the housing 16 may be condensed in a liquid state. Before the mercury can be ionized as the plasma, it must first be vaporized. Low temperature ambient conditions may make it difficult to vaporize the liquid mercury.

To initiate lighting of the lamp 10, the starter 20 first heats the cathodes 18. The starter 20 establishes a closed circuit between the cathodes 18 for a period of time during which the current flows through both cathodes and the starter and heats the cathodes. The heat from the cathodes helps vaporize the mercury within the housing 16. The heated cathodes 18 also emit low work energy ions from material coated on the surface of the cathodes. The emitted ions create an ionized cloud surrounding each cathode 18. This ionized cloud assists in establishing a break-over arc between the cathodes 18 to start the lamp 10 and to maintain it lighted.

After heating the cathodes 18, the starter 20 opens the circuit conducting current through the cathodes 18. The current flow terminates almost instantaneously, causing a relatively high change in current in a relatively short amount of time (di/dt). The ballast 12 responds to the relatively high di/dt by producing a very high voltage pulse 22 as shown in FIG. 2. In a typical fluorescent lamp circuit powered by a conventional 120 volt RMS source 14, the voltage pulse will typically be in the range of 400 to 700 volts.

The pulse 22 is of sufficiently high voltage to break down the ionized electron cloud and the mercury vapor within the housing 16, thereby conducting an arc between the cathodes 18. The arc jumps directly between the cathodes 18 because the starter 20 has opened and no longer presents a current path between the cathodes. The current of the arc creates a plasma to light the lamp 10. The current flow through the plasma between the cathodes 18 thereafter continues to heat the cathodes 18. The heated cathodes are sufficient to maintain enough ionization to allow the normal AC voltage from the source 14 to ignite the plasma during the subsequent half cycles of applied AC voltage 24, shown in FIG. 2, without the need for further high voltage starting pulses 22. The plasma emits ultraviolet light which interacts with phosphorus placed on the interior of the housing 16, and the phosphorus emits visible light.

The typical voltage characteristics applicable to the fluorescent lamp 10 are shown in FIG. 2. The applied voltage from the conventional AC power source 14, such as a 60 hertz 120 volt RMS signal, is shown at 24. Under operating conditions, the voltage across the cathodes 18 builds up until an ignition or break-over voltage 26 is reached, at approximately 125 volts. The ignition voltage may vary somewhat depending on the heat of the cathodes and the extend of vaporization, but the voltage 26 necessary to sustain the plasma state remains approximately constant after steady state conditions are attained. Because the 177 volt peak voltage of the 120 volt RMS signal is considerably greater than the ignition voltage 26, the current between the cathodes 18 through the plasma will increase to an unacceptable level unless the ballast 12 is employed. The ballast 12 limits the current under plasma ignition conditions.

One well known type of starter 20 is a simple push button mechanical starter switch. The user holds the switch closed for a short time period to allow the cathodes 18 to heat and then at some random time releases the starter switch. If the cathodes 18 are sufficiently heated and if the starter button is released when the applied AC voltage 24 across the cathodes 18 is at or above the ignition voltage 26, the lamp 10 will light. If the right combination of cathode heat and the starter switch release point does not occur, an additional attempt to light the lamp 10 is required. The disadvantage of the mechanical switch starter is that it requires manual intervention, at least once and maybe many times, to light the lamp 10.

Another well known type of starter 20 is known as a "glow bottle". A glow bottle is an evacuated housing within which there are positioned a radioisotopic ionizable gas and a bimetal switch. The glow voltage of the radioisotopic gas is above the level of the lamp ignition voltage 26 shown in FIG. 2. When the fluorescent lamp 10 is not lighted the full voltage of the source 14 is impressed across the glow bottle. The radioisotopic gas breaks down, begins to glow and heats the bimetal switch. When the bimetal switch becomes hot enough, it closes and shunts the voltage away from the radioisotopic gas in the glow bottle and conducts current through the cathodes 18 to heat them. The radioisotopic gas starts cooling when the bimetal switch closes, causing the bimetal switch itself to begin to cool.

When the bimetal switch has cooled sufficiently, it opens and causes a high di/dt. The ballast 12 responds to the di/dt by applying the high voltage pulse 22 to the warmed cathodes 18. The lamp 10 will only be lighted if the bimetal switch opens at a time when the AC voltage 24 across the cathodes 18 is above the ignition voltage 26. Once the fluorescent lamp is lighted, the voltage across the gas in the glow bottle never reaches a high enough value to cause the radioisotopic gas to glow, because the ignition voltage 26 is lower than the ionization voltage of the radioisotopic gas. Once the lamp is extinguished, the glow bottle will again become operative.

One of the advantages of the glow bottle is that it is self-starting. Any time that the lamp 10 extinguishes, the applied voltage from the AC source is applied to the radioisotopic gas to make it glow, and the operation described above occurs. One of the primary disadvantages of the glow bottle is the random and long time delay in igniting the fluorescent lamp when the power is first applied to it. The delay while the glow bottle functions may result in frustration to the user who expects immediate light when the light switch is closed. Another disadvantage to the glow bottle is that good regulation of the applied voltage from the source 14 is required to break down the radioisotopic gas under the proper conditions and to prevent it from breaking down during times when the lamp is lighted.

The voltage regulation of power delivery in some parts of the world makes it difficult or impossible to use glow bottle starters or indeed even fluorescent lamps. It is also difficult to use fluorescent lamps with manual starters in circumstances of frequent momentary or longer power interruptions because the lamp must be manually restarted after each interruption. Unfortunately, the economic circumstances which give rise to the power delivery difficulties are usually the same economic circumstances where more lighting which consumes less electrical energy would be of great benefit. Combined with the difficulties that low ambient temperatures pose for starting or igniting fluorescent lamps, the convenient and successful applications of fluorescent lamps may be limited. Many of these difficulties are directly attributable to the shortcomings of the typical fluorescent lamp starter.

Attempts to improve the functionality and reliability of starters have included the use of semiconductor electronic circuits. One of the significant difficulties with a semiconductor starter circuit has resulted because of the relatively high voltage pulses 22 will destroy most common semiconductors such as bipolar junction transistors, FETs and the like. Some semiconductor devices such as MOSFETs and triacs have deeply diffused junction profiles and therefore capable of withstanding very high voltages, but may be expensive and difficult to employ in numbers which are economical or difficult to incorporate in an integrated circuit.

It is with respect to this and other background information that the present invention has evolved.

SUMMARY OF THE INVENTION

One of the improved aspects of the present invention relates to a starter, preferably a solid state starter, for a fluorescent lamp which will automatically and rapidly respond to an extinguished fluorescent lamp, to heat the cathodes and apply a relatively high voltage start pulse at a time coordinated with the impression of a relatively high voltage from the AC power source to reliably ignite the mercury plasma and light the fluorescent lamp. Another improved aspect of the invention relates to a solid state starter which reliably applies a high voltage start pulse when the applied voltage from the AC source is at a level sufficient to sustain and maintain the ignition voltage to the fluorescent lamp. An additional improved aspect of the invention relates to a solid state starter which is capable of lighting or igniting a fluorescent lamp nearly instantaneously. A further improved aspect of the invention relates to a solid state fluorescent lamp starter that operates reliably under poor line voltage regulation and low voltage conditions. Yet a further improved aspect of the invention relates to a solid state starter that automatically starts the fluorescent lamp in response to unexpected extinguishing of the lamp from momentary and long term power interruptions, power line regulation problems or the like. Another improved aspect of the present invention relates to a starter for a fluorescent lamp which achieves various timing functions for turning the lamp on or off automatically, or which dims the fluorescent lamp to achieve multiple levels of illumination. A last improved aspect of the present invention relates to a solid state starter for a fluorescent lamp which advantageously employs a thyristor with an advantageous relatively high holding current characteristic for starting the fluorescent lamp.

In accordance with these and other aspects, a starter of the present invention is used with a fluorescent lamp which has cathodes connected to a ballast in a circuit energized by an alternating (AC) power source. The starter lights the lamp by igniting a plasma, and the voltage from each half cycle of the AC power thereafter sustains the plasma. The starter is adapted to be connected to the cathodes of the lamp and when so connected operates to selectively conduct current from the AC power source through the ballast and the cathodes during one half cycle of conducted current from the AC power source. Thereafter and during the same on half cycle of current the starter ceases conducting current substantially instantaneously at a predetermined time when the current is of a predetermined level to establish a sufficient change in current per change in time (di/dt) to generate a starting voltage pulse from the ballast between the cathodes sufficient to ignite the plasma. The predetermined time at which the di/dt creates the voltage pulse is when the voltage of the AC power across the cathodes exceeds a predetermined ignition voltage of the plasma. Preferably the starter employs a thyristor which has a predetermined holding current at least equal to the predetermined level. When the conducted current from the AC power source decreases to the holding current level, the inherent commutation of the thyristor near the end of the one half cycle of conducted current creates the di/dt. The voltage pulse from the di/dt occurs in synchronization with the applied AC voltage impressed voltage on the cathodes from the AC power source, due to the phase shift between the current and the voltage conducted by the ballast. The current conducted by the thyristor is generally sufficient to adequately heat the cathodes to sustain ignition of the plasma. A voltage sensing capability associated with the starter triggers the thyristor into conduction only when the voltage across the cathodes exceeds the ignition voltage of the plasma, which occurs when the fluorescent lamp is not lighted, and therefore automatically starts the lamp.

In accordance with other aspect of the present invention, the starter can be employed to advantageously extinguish the fluorescent lamp on a repetitive basis during a selected number of applied cycles of the AC power. Extinguishing the fluorescent lamp on a periodic basis reduces the overall amount of illumination. Because the starter can also quickly re-ignite the lamp, the selective igniting and extinguishing of the lamp over a number of applied cycles of the AC power achieves a dimming function. The same functionality may be utilized to turn on or turn off the fluorescent lamp after a predetermined time. This functionality may also be programmed by predetermined power interruptions applied to a control circuit of the starter.

Other aspects of the invention relate to a method of lighting a fluorescent lamp having cathodes connected to a ballast in a circuit energized by an alternating (AC) power source. The method includes the steps of conducting current from the AC power source through the ballast and the cathodes during one half cycle of applied AC current, ceasing conducting current substantially instantaneously during the one half cycle when the current is of a predetermined level to establish a sufficient change in current per change in time (di/dt) to generate a starting voltage pulse from the ballast between the cathodes sufficient to ignite a plasma between the cathodes, creating the di/dt at a predetermined time during the one cycle when the voltage of the AC power across the cathodes exceeds a predetermined ignition voltage of the plasma, igniting the plasma by applying the voltage pulse across the cathodes, and maintaining the plasma between the cathodes during half cycles of applied AC power subsequent to the one half cycle by applying a voltage from the AC power source to the cathodes. The method also preferably includes the steps of selecting a thyristor which has a holding current at least equal to the predetermined level of current at the time of the di/dt, connecting the thyristor to conduct current between the cathodes, gating the thyristor on at the beginning of the one half cycle of conducted current, and commutating the thyristor off by decreasing the current from the AC power source to the holding current level of the thyristor near the end of the one half cycle of conducted current.

A more complete appreciation of the present invention and its scope can be obtained by reference to the accompanying drawings, which are briefly summarized below, the following detailed description of presently preferred embodiments of the invention, and the appended claims.

BRIEF DESCRIPTION OF THE DRAWINGS

FIGS. 4A, 4B have 4C have a common time axis.

DETAILED DESCRIPTION

Figure 1:
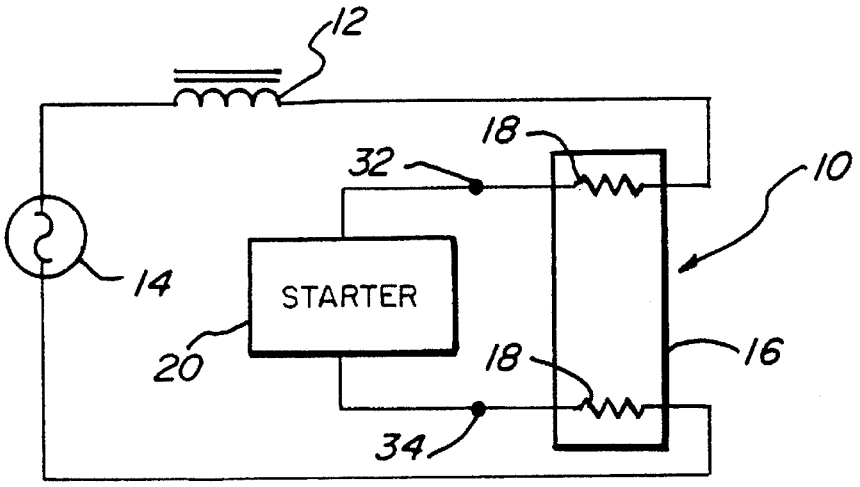
Fig. 1 PRIOR ART
FIG. 1 is a simplified circuit diagram of a prior art fluorescent lamp, a starter, and a ballast connected to a conventional AC power source.
Figure 3:
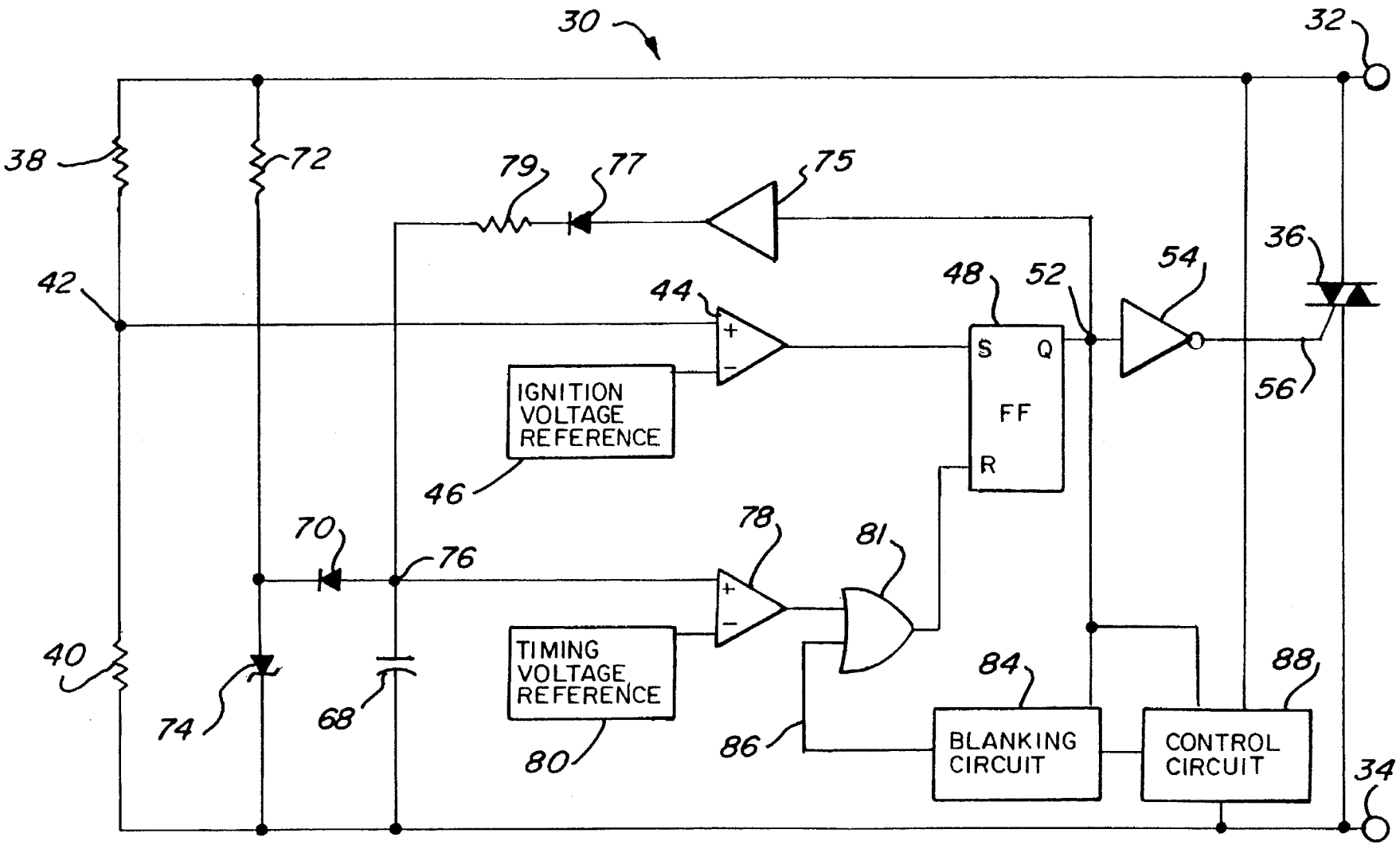
FIG. 3 is a partial block and partial schematic diagram of an improved starter for a fluorescent lamp which embodies the present invention.

A solid state starter 30 which embodies the present invention is shown in FIG. 3. The solid state starter 30 is intended to be used in place of the starter 20 shown in FIG. 1. Terminals 32 and 34 connect to the cathodes 18 of the fluorescent lamp 10 as shown in FIG. 1.

The starter 30 preferably utilizes a high holding current thyristor such as a SCR, a triac 36 or other type of semiconductor current switching device. Details concerning the triac 36 and the manner by which a high holding current is obtained are described in the concurrently filed U.S. Patent application Ser. No. (H&H 32263.8310). As is discussed below, the high holding current characteristic of the triac 36 is advantageously used in the starter 30 to create the high voltage start pulse 22 to ignite the fluorescent lamp. The triac 36 is capable of withstanding the high voltage of the starting pulse due its deeply diffused junction profiles, as is described in the aforementioned application. In order to be effective in the starter 30, the holding current of the triac 36 or other semiconductor thyristor should be greater than 30 milliamps, and preferably in the neighborhood of 50–150 milliamps.

Figure 2:
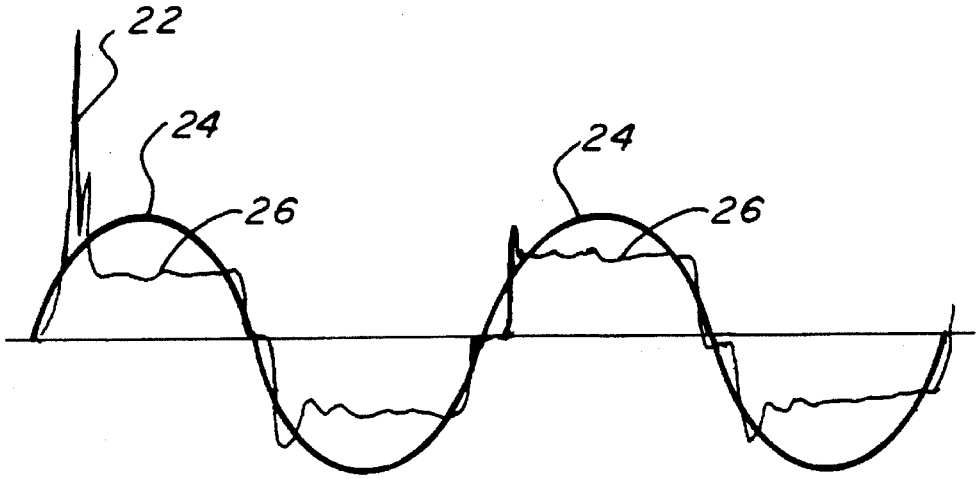
Fig. 2 PRIOR ART
FIG. 2 is a waveform diagram of the voltages in the prior art circuit shown in FIG. 1.

In general, the function of a current conduction initiation portion of the starter 30 is to sense the presence of voltages across the lamp cathodes (18, FIG. 1) in excess of the ignition voltage (26, FIG. 2). Upon sensing this condition, the triac 36 is triggered, which conducts current through and heat the cathodes. Then, when the current flowing through the triac 36 diminishes to the holding level at a time when the applied AC current waveform is approaching a zero crossing level, the triac immediately commutates to a non-conductive state at an advantageous time to create a high di/dt through the ballast (12, FIG. 1), when the applied voltage from the AC power source (14, FIG. 1) is higher than the ignition voltage (26, FIG. 2), thereby lighting the fluorescent lamp.

The current conduction initiation portion of the starter 30 includes a pair of resistors 38 and 40 connected as a voltage divider between the terminals 32 and 34. A sensing node 42 reduces the voltage between the terminals 32 and 34 to a level sufficient for use by conventional digital and/or analog circuit elements. The voltage present at node 42 is applied to the positive input terminal of a comparator 44. An ignition reference voltage 46 is applied to the negative input terminal of the comparator 44. The voltage at reference 46 is directly related to the ignition voltage (26, FIG. 2) of the fluorescent lamp 10 during operation. The voltage divider formed by the resistors 38 and 40 provides a comparable relationship for the applied AC line voltage at terminals 32 and 34.

Figure 4A:
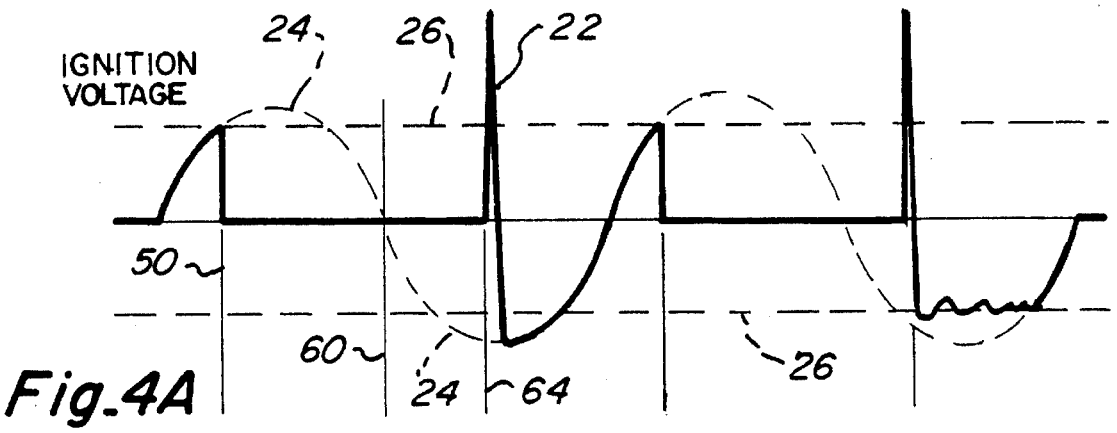
FIGS. 4A is a waveform diagram of the voltage appearing across the fluorescent lamp shown in FIG. 1 when the starter shown in FIG. 3 is used.

The comparator 44 senses a condition when the voltage at node 42 exceeds the voltage of reference 46, and in response to this condition, supplies a signal to the set terminal of a flip flop 48. The condition is shown in FIG. 4A and exists whenever the voltage 24 of the AC power applied between the cathodes (18, FIG. 1) exceeds the ignition voltage 26. This condition occurs when the fluorescent lamp is not lighted, and indicates the necessity for the starter 30 to light the fluorescent lamp.

Figure 4B:
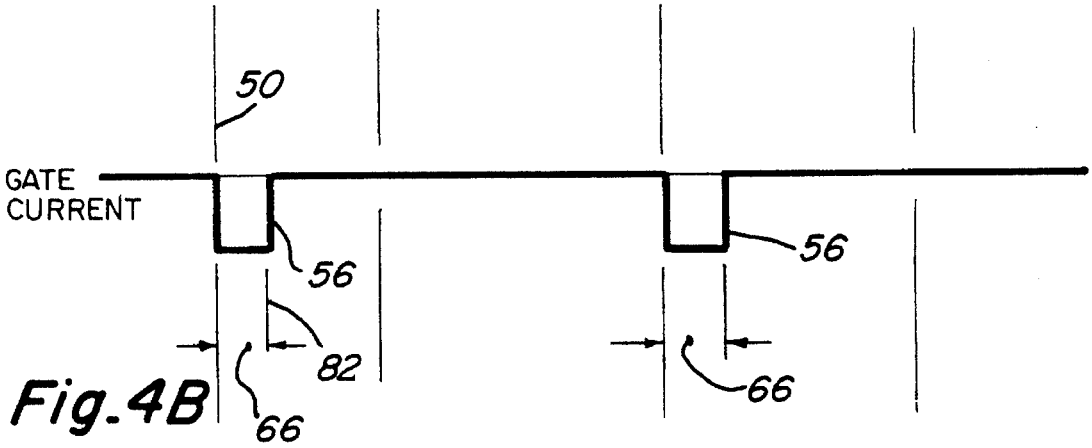
FIG. 4B is a waveform diagram of a trigger signal appearing in the starter shown in FIG. 3.

The signal from the comparator 44 sets the flip flop 48 at time 50, as shown in FIG. 4A. Once set, the flip flop 48 supplies a high level signal at 52 on its Q output terminal. The high signal is applied to an inverter 54, which supplies a resulting low output signal at 56 to the gate of the triac 36. FIG. 4B illustrates the gate signal 56. A negative going excursion of the gate signal 56 (relative to terminal 34) at time 50 triggers the triac 36 into conduction, and current starts the flow of current through the triac 36, the cathodes and the ballast (18 and 12, respectively, FIG. 1). The current waveform is shown at 58 in FIG. 4C. Because of the current limiting impedance and effect of the ballast, the current increases approximately linearly until the applied AC voltage waveform 24 (FIG. 4A) changes polarity at a zero crossing point at time 60. At time 60, the current in the ballast starts decreasing approximately linearly and continues to decrease until the current reaches the holding current level 62 of the triac 36 shown in FIG. 4C. When the current waveform 58 reaches the holding current level 62, the triac 36 almost instantaneously stops conducting current, as shown at time 64 in FIG. 4C. The almost instantaneous change in current from the holding current level 62 to the nonconductive state occurs in a few nanoseconds and creates a relatively high change in current per change in time (di/dt).

Because the relatively high holding current characteristic of the triac 36, a considerably higher di/dt is created than would exist with a conventional semiconductor thyristor. This relatively high di/dt causes the ballast (12, FIG. 1) to generate the high voltage pulse 22 at time 64 as shown in FIG. 4A. Because the current flow through the ballast is phase shifted by about 90 degrees in time the voltage impressed from the source 14 (the half cycles of the current waveform 58, FIG. 4C, lag the half cycles of the applied voltage 24, FIG. 4A), the high voltage pulse 22 occurs when the impressed voltage 24 across the cathodes is near its peak value and above the ignition voltage level 26. This timing maximizes the opportunity to ignite the mercury plasma in the fluorescent lamp. If however the lamp is not immediately ignited by the first high voltage pulse 22, the circuit will again respond as described to create a second subsequent high voltage pulse 22 during the next complete cycle of applied AC power. This repeating operation continues until the lamp lights.

Between the time points 50 and 64, the triac is conductive to warm the cathodes by conducting current through them. Thus, heating the cathodes is immediately followed by the impression of the high voltage starting pulse 22 at a time for sustaining ignition as a result of applied AC voltage exceeding the ignition voltage.

Because the triac 36 has a high holding current, the width of the pulses of the gate trigger signal 56 must be sufficiently wide to bias the triac 36 into the conductive state until the current flow through the ballast has increased sufficiently to maintain the triac in the latched or conductive condition. The width of the gate trigger signals 56 is referenced at 66 in FIG. 4B. To assure sufficient width 66 of the gate trigger signals 56, the remaining circuit elements of the starter 30 are employed to terminate the triac trigger signal 56.

The starter 30 employs a timing circuit whose time constant is directly related to the holding current required by the triac 36 and the current limiting characteristics of the ballast. One type of timing circuit includes a capacitor 68, a diode 70 and a resistor 72 which are connected in series between the terminals 32 and 34. A Zener diode 74 is connected in parallel with the capacitor 68 in diode 70 and from the resistor 72 to the terminal 34.

During those half cycles of the applied AC power waveform where terminal 34 is positive with respect to terminal 32, the capacitor 68 charges through diode 70 and resistor 72 to a voltage level equal to the breakdown voltage of the Zener diode 74, less the forward bias voltage of the diode 70. The plate of capacitor 68 connected to terminal 34 charges positive while the other plate of the capacitor 68 connected to node 76 charges negative. The negative voltage at node 76 (with respect to terminal 34) is applied to the positive input terminal of a comparator 78. A timing reference voltage at 80 (also negative with respect to terminal 34) is applied to the negative input terminal of the comparator 78.

Figure 4C:
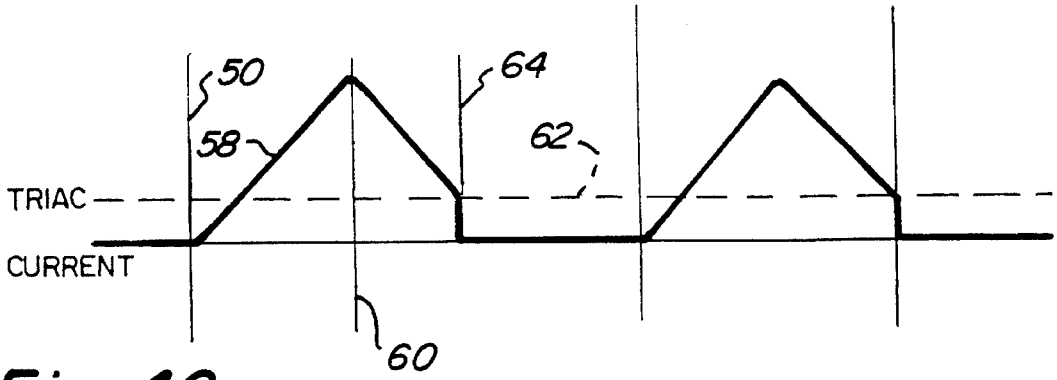
FIG. 4C is a waveform diagram of the current conducted through the ballast shown in FIG. 1 when the starter shown in FIG. 3 is employed.

As soon as the triac 36 becomes conductive at time 50 as shown in FIGS. 4A, 4B and 4C as a result of the Q output signal 52 from the flip flop 48, the triac 36 effectively connects the resistor 72 to the terminal 34. The high Q output signal 52 from the flip flop is applied to a buffer amplifier 75 where it is current amplified. Current from the buffer amplifier 75 is conducted through a diode 77 and a resistor 79 to the node 76. The previously charged capacitor 68 supplies a negative voltage at node 76 at this time and the current flow from the buffer amplifier 75, diode 77 and resistor 79 discharges the capacitor 68 at a time constant established primarily by the capacitor 68 and the resistor 79. When the negative voltage at node 76 decays to a point where it is higher negatively than the negative voltage from reference 80, the comparator 78 supplies a high level reset signal to an OR gate 81. The OR gate 81 conducts the reset signal to the reset terminal of the flip flop 48, thereby resetting the flip flop and terminating the Q output signal 52 and the trigger signal at time 82 (FIG. 4B).

By adjusting the magnitude of the voltage from the timing voltage reference 80 in relation to the time constant of the capacitor 68 and resistor 79, the time width 66 of the triac trigger signal 56 is sufficient to assure enough current will be flowing through the triac 36 to maintain it in the latched condition before the trigger signal 56 is terminated at time 82. The triac remains conductive at 66 from the time points 50 through 82 as shown in FIGS. 4A and 4C because of the application of the trigger signal 56. Once the trigger signal is terminated at time 82, current continues to flow through the triac because it is latched, thereby assuring that the triac 36 will commutate at time 64 when the current drops below the holding current level 62.

The starter 30 generates the high voltage pulses 22 with each complete cycle of the applied AC power waveform until the lamp lights. Once the lamp lights, the voltage across the cathodes (18, FIG. 1), as sensed at node 42, does not rise above the ignition voltage 26, represented by the ignition reference voltage 46. The comparator 44 does not create a signal to cause the triac to be triggered, thus terminating any further effect from the starter 30 while the lamp remains lighted.

Should the lamp unexpectedly extinguish due to a momentary power interruption, the starter 30 will become operative immediately with the next full cycle of applied AC current to attempt to ignite the lamp. The circuit will automatically supply the high voltage ignition pulses until the lamp lights. In cold environments, the lamp will typically be ignited in one second or less with the starter 30. At room temperatures, the lamp usually lights in just a few AC cycles. Under conditions of low line voltage, the relatively high holding current creates a sufficiently high di/dt effect to obtain high voltage start pulses of a sufficient magnitude that reduces the negative effect of relatively large variations in voltage regulation. If the lamp is extinguished by a momentary power interruption, it will immediately be lighted. If the lamp is extinguished by a long term power interruption, it will immediately be lighted when the power resumes.

The high voltage pulse 22 which occurs when the triac 36 commutates at the time point 64 will also be sensed by the voltage divider formed by resistors 38 and 40. The high voltage pulse 22 will cause the comparator 44 to apply a set signal to the flip flop 48, unless such operation is inhibited. If a trigger signal 56 was to be applied at the time 64 the triac would be triggered and the high voltage pulse 22 would not develop to its maximum voltage.

To prevent the triac 64 from turning on in response to the high voltage pulse 22, a blanking circuit 84 supplies a high level blanking signal at 86 through the OR gate 80 to the reset terminal of the flip flop 48. The blanking signal 86 maintains the flip flop 48 in a reset state to inhibit the effect of a momentary high level set signal from the comparator 44 created by the high voltage pulse 22. The blanking signal 86 is asserted in a timed relationship to the assertion of the Q output signal 52 from the flip flop, thereby assuring that the blanking signal 86 exists before the time 64 when the triac 36 stops conducting current because the current decreases below the holding level 62. Other types of circuit sensing arrangements for causing the blanking circuit 84 to assert the blanking signal 86 through the OR gate 81 are also possible.

A control circuit 88 is used in conjunction with the blanking circuit 84 to achieve unique functional features from a fluorescent lamp. The control circuit 88 controls the blanking circuit 84 to achieve timing or programmed operational features of the lamp. For example, the control circuit 88 may control the starter 30 to light the lamp at or after a predetermined time, to extinguish the lamp at or after a predetermined time or to modulate imperceptibly the on and off time periods of the lamp on a cycle by cycle basis of the applied AC power to obtain different illumination intensities from the fluorescent lamp. Other types of control functions are also possible.

The control circuit 88 is preferably a digital processing type microcontroller or microprocessor such as is described in U.S. Pat. Nos. 5,030,890; 5,126,634; 5,214,354; and 5,264,761, all of which are assigned to the assignee hereof. The control circuit 88 in conjunction with the blanking circuit 84 extinguishes the lamp 10 and allows the lamp 10 to light in the manner previously described. The control circuit 88 is connected to the terminals 32 and 34 to sense power interruptions and zero crossing points of the applied AC power. The control circuit 88 may be programmed by selectively applied power interruptions to achieve a number of different control functions as described in the aforementioned U.S. Patents.

To turn off the lamp, the control circuit 88 sends a high level signal to the inverter 54, thereby creating a trigger signal at 56 to trigger the triac 36. The triggered triac connects the terminals 32 and 34 and prevents current flow between the cathodes (18, FIG. 1). The plasma in the lamp 10 is immediately extinguished. As the current flowing through the cathodes decreases to the holding level at the end of the cycle of applied AC current, the normal blanking effect of the circuit 86 is inhibited by a control signal supplied by the control circuit 88 to the blanking circuit 84. That is, as the high voltage pulse 22 starts to develop, the signal from the comparator 44 triggers the triac 36 because the blanking circuit 86 is not inhibited. The conductive triac 36 dampens or diminishes the starting pulse 22 from developing to its maximum high voltage of approximately 400 to 700 volts, thus preventing conduction between the cathodes. Consequently, the lamp remains extinguished. Even though the cathodes are warmed by the current flowing through them, the absence of the high voltage starting pulse prevents the lamp from lighting. Thereafter, the triac 36 is no longer triggered as a result of the control circuit 88 controlling the blanking circuit 84 to assert the reset signal to the flip flop 48. The fluorescent lamp is quickly turned off or extinguished within one cycle of applied AC power.

Another effect which may be achieved utilizing the quick extinguishing feature just described is dimming the illumination from the fluorescent lamp. Dimming is accomplished by periodically, after a predetermined number of cycles, extinguishing the fluorescent lamp for one or more cycles in the manner described above and then quickly restarting the lamp immediately in the next applied AC cycle. The predetermined number of applied AC cycles of lighting the lamp compared to the number of cycles of extinguishing the lamp is selected to create an imperceptible effect on human vision. By modulating the on and off times of the fluorescent lamp in this manner different levels of illumination are achieved. Modulating the on and off times is possible because of the rapidity and reliability with which the starter 30 is capable of lighting and extinguishing the fluorescent lamp.

Another example of features achieved by the control circuit 88 include turning the fluorescent lamp on or off at predetermined times. In this case the control circuit 88 includes a timer which allows the starter 30 to function at a predetermined or programmed time. Another example relates to turning the lamp on or off in response to a sensed ambient light condition. In this circumstance, the control circuit 88 includes an ambient light sensor, and the control circuit 88 respond to light sensed by the light sensor.

As is apparent from the preceding discussion, the circuit elements of the starter 30 which are operative to assert the reset signal to the reset terminal of the flip flop 48 function as a current conduction termination circuit portion of the starter 30,. Current flow is terminated through the triac 36 under the different circumstances described. The thyristor or triac 36 forms part of both the current conduction termination portion of the starter 30 and the current conduction initiation portion of the starter 30.

Figure 5:
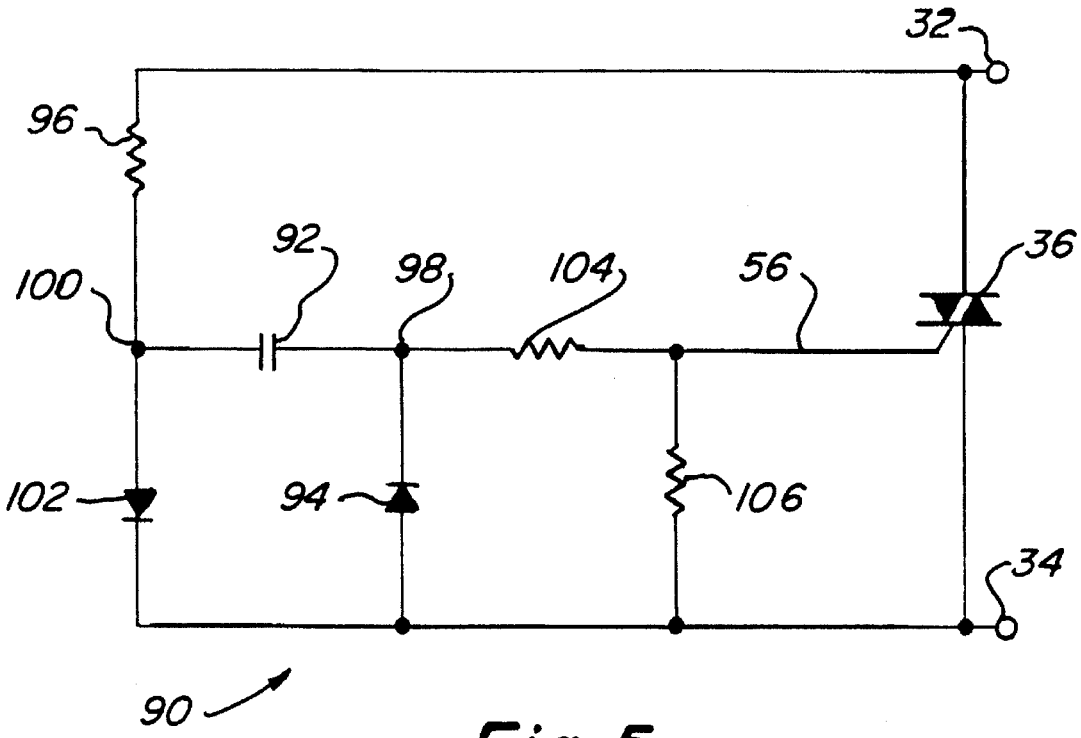
FIGS. 5, 6 and 7 are circuit diagrams of alternative embodiments of the starter shown in FIG. 3.

The present invention may also be embodied a simplified version of a starter 90 shown in FIG. 5. Although simplified, the starter 90 obtains the essential features of starting and extinguishing the fluorescent lamp by the use of the high holding current thyristor and terminating the current conduction and preventing re-triggering of the thyristor. The starter 90 is connected at terminals 32 and 34 in the circuit shown in FIG. 1.

During a negative half cycle of the applied AC power waveform (24, FIG. 4A) when terminal 34 is positive with respect to terminal 32, a capacitor 92 is charged through a forward biased diode 94 and a resistor 96. The time constant established by the capacitor 92, diode 94 and resistor 96 causes the voltage across the capacitor 92 to build up to a predetermined level, with the voltage at node 98 being positive with respect to the voltage at node 100. A diode 102 is reverse biased and therefore not conductive during this negative half cycle of the applied AC waveform.

During the immediately following positive half cycle of the applied AC waveform when terminal 32 is positive with respect to terminal 34, the diode 102 becomes forward biased, which causes the node 100 to essentially be coupled to the terminal 34 through the diode 102. The voltage across the capacitor 92 becomes positive at node 98 with respect to the voltage at terminal 34. The predetermined voltage which built up across the capacitor during the previous half cycle then discharges through resistors 104 and 106 and creates the signal at 56 at the gate of the triac 36, thus turning the triac 36 on at the time point 50 shown in FIG. 4A. In this case, the triac 36 is of the variety which responds to a positive trigger signal 56.

The capacitor 92 continues to discharge during the positive half cycle of the applied AC waveform, at a rate established by the time constant of the capacitor 92 and the resistor 104 and 106. The discharge time constant of the capacitor 92 is selected so that the triac 36 is not in a triggered condition when the current through the triac 36 decreases to the holding level, at which point it ceases conducting. The resultant high di/dt value causes the starting pulse 22 to light the fluorescent lamp.

During the following negative half cycle of the applied AC waveform the capacitor 92 begins recharging. However, because the fluorescent lamp ignited during the previous AC cycle, the voltage across the terminals 32 and 34 only reaches the level of the ignition voltage 26 (FIG. 2). The ignition voltage level 26 is not high enough to sufficiently charge the capacitor 92 with enough voltage during the negative half cycles to cause enough of a voltage discharge during the positive half cycles across resistor 106 to trigger the triac 36. Consequently, the triac 36 in no longer triggered so long as the lamp is lighted. Should the fluorescent lamp extinguish, the voltage across terminals 32 and 34 will rise to a sufficient level across capacitor 92 to thereafter trigger the triac 36 and automatically restart the fluorescent lamp.

Figure 6:
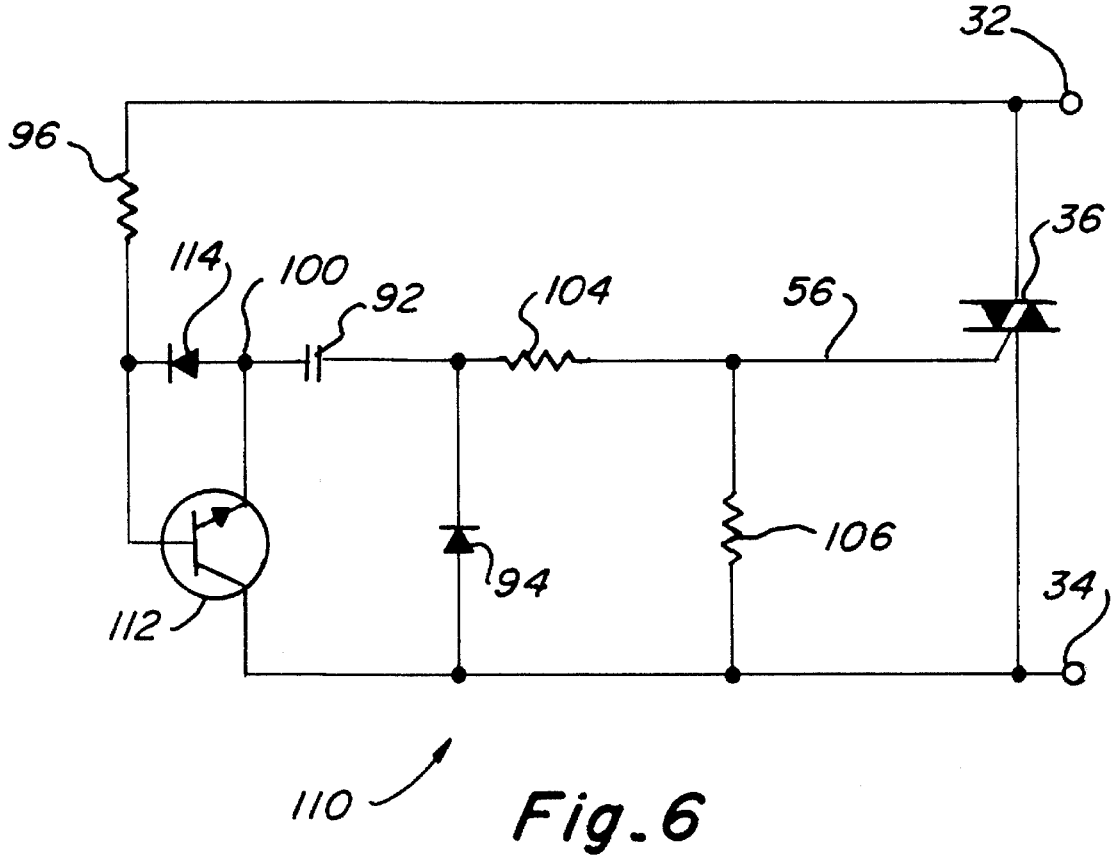

Another starter 110 which embodies the present invention and which is an alternative to the starter 90 is shown in FIG. 6. The starter 110 incorporates many of the same components as described in conjunction with the starter 90 (FIG. 5), but also includes a transistor 112 connected between the node 100 and the terminal 34. A diode 114 is connected between the collector and base of the transistor 112. The transistor 112 and the diode 114 achieve a function related to the function of the diode 102 in the starter 90 (FIG. 5).

The function of the transistor 112 is to amplify the current conducted between the node 100 and the terminal 34 during the positive half cycles. The current amplification effect is achieved because the diode 114 biases the transistor 112 strongly on when the positive half cycle of the applied AC waveform is applied. The current flowing through the collector and emitter terminals of the transistor 112 assures that node 100 is effectively connected to the terminal 34. As a result the voltage across the capacitor 92 is positively referenced with respect to the terminal 34, thereby achieving more reliable and consistent operation than may occur if the current flow through the diode 102 (FIG. 5) is insufficient to fully forward bias that diode. Thus, the transistor 112 achieves a moire direct and reliable connection of the node 100 with the terminal 34 than might be possible with a diode 102 under low current conditions.

Figure 7:
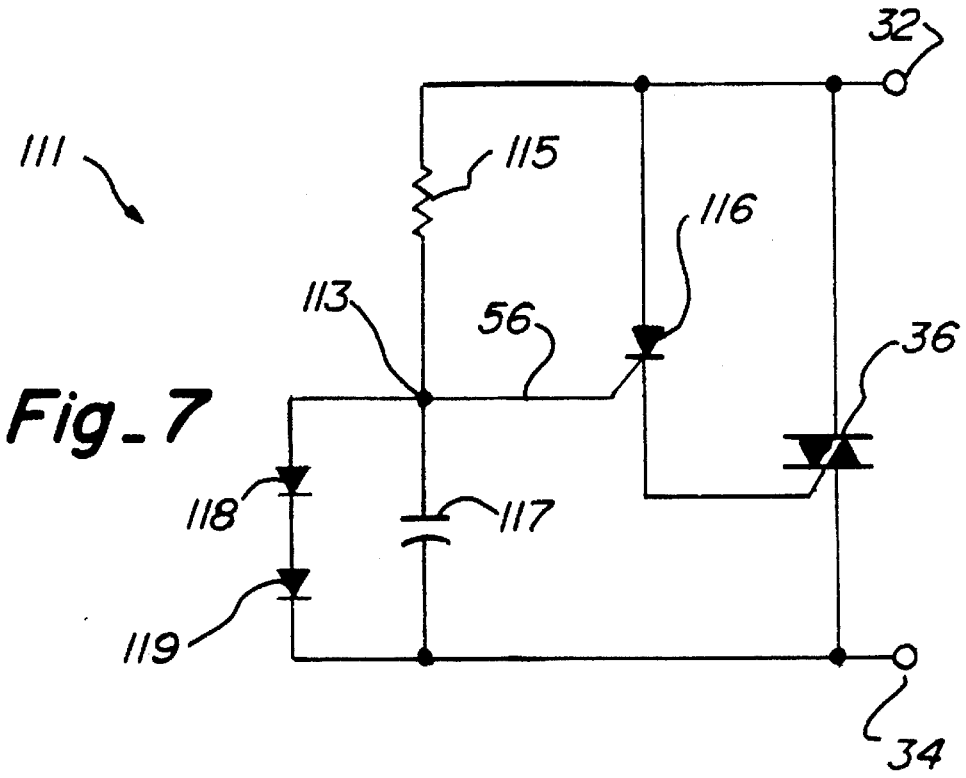

Another starter 111 which embodies the present invention and which is suitable for complete integration on a single integrated circuit chip is shown in FIG. 7. The triac 36 is connected between the terminals 32 and 34. A gate drive SCR 116 is connected between the terminal 32 and the gate of the triac. A gate of the SCR 116 is connected to a node 113 where a resistor 115 and a capacitor 117 are connected. The resistor 115 and capacitor 117 are connected between the node 113 and the terminals 32 and 34, respectively. A pair series connected diodes 118 and 119 are connected from the node 113 to the terminal 34 in parallel with the capacitor 117.

During half cycles when terminal 32 is positive with respect to terminal 34, the capacitor 117 charges through the resistor 115. The voltage at terminal 113 reaches the trigger voltage of the SCR 116, and the SCR 116 fires and delivers a current signal to the gate of the triac 36. The triac 36 immediately becomes conductive, and the voltage between the terminals 32 and 34 collapses due to the fully conductive triac 36. The voltage difference between terminals 32 and 34 becomes so small that it is insufficient to maintain the conductivity of the SCR 16. Because the cathode of the SCR 116 is connected through the gate of the triac 36, there are at least three junction drops in voltage between terminal 34 through the SCR 116 to terminal 32, which is at least one more junction drop than occurs through the triac 36. As a consequence, there is insufficient voltage across the SCR 16 to turn it off.

The charge on capacitor 117 maintains the trigger signal 56 to the gate of the SCR 116 for a long enough period of time until the current through the triac 36 exceeds the holding level, at which time the triac 36 is fully conductive. The triac 36 remains conductive until the current from the AC power source through the terminals 32 and 34 decreases below the holding level. At that time, the almost instantaneous change in current from the holding current level to the non-conductive level creates the di/dt effect. The resulting high voltage start pulse at terminals 32 and 34 is essentially absorbed by the resistor 115 and capacitor 117, which function as a filter. The start pulse creates an insufficient charge on the capacitor 117 to raise the voltage level at terminal 113 enough to trigger the SCR 116.

When the fluorescent lamp ignites, the voltage between terminals 32 and 34 is fixed at the ignition voltage level. The ignition voltage will charge the capacitor 117, but only to a level at node 113 which is insufficient to fire the SCR 116. Consequently, the starter 111 does not operate after the lamp has been lighted.

The diodes 118 and 119 are used primarily for temperature compensation. Temperature affects the diodes 118 and 119 in a similar manner as it effects the SCR 116 and the triac 36, thereby stabilizing the semiconductor effects relative to temperature changes.

Figure 8:
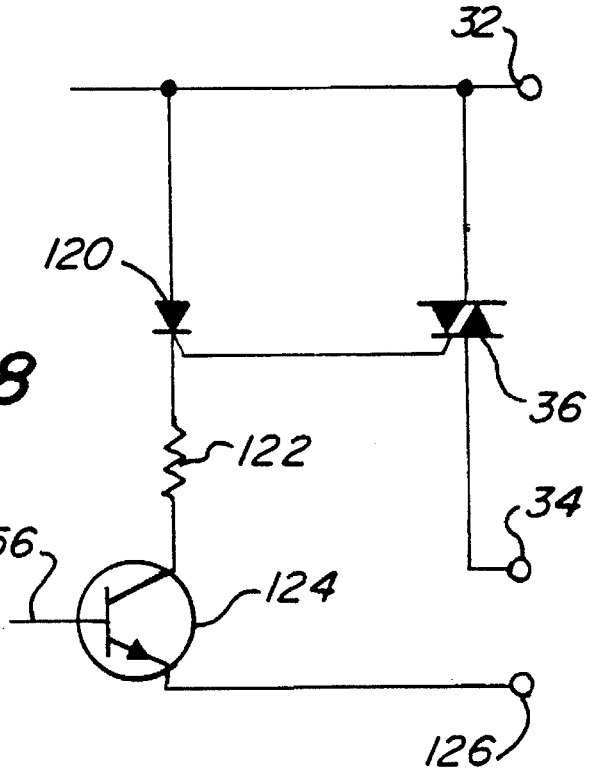
FIG. 8 is a circuit diagram of a portion of a starter circuit which may be employed as an alternative to related portions of the circuits of the starters shown in FIGS. 3, 5, 6 and 7.

Typically, a high holding current triac will also characteristically require a relatively high gate current to trigger the triac into conduction. This characteristic of the triac is described more completely in the aforementioned concurrently filed U.S. patent application Ser. No. (08/257,899) although this application also describes a type of triac which has a low trigger current and a high holding current. FIGS. 7 and 8 disclose circuit arrangements for amplifying the current drive from the trigger signal 56 to adequately trigger a high holding current triac 36 which also requires a high trigger current. The circuit arrangements shown in FIGS. 7 and 8 may be applied in any of the starter embodiments of the present invention.

The SCR 116 of the starter 111 shown in FIG. 7 has high sensitivity and requires a relatively low gate current at 56 to trigger it. Once triggered, the SCR 116 applies an amplified, greater drive current to the gate terminal of the triac 36, thus triggering the triac 36 into conduction.

An alternative low current, high sensitivity gate drive circuit for the triac 36 is shown in FIG. 8. The anode of an SCR 120 is connected to the terminal 32. The gate of the SCR 120 is directly connected to the gate of the triac 36. The cathode of the SCR 120 is connected through a resistor 122 to the collector of a transistor 124. The emitter of transistor 124 is connected to a low voltage source (not shown) at terminal 126. The voltage at terminal 126 will be lower than the voltage at terminal 34 when it is desired to trigger the triac 36. The trigger signal 56 of a low current magnitude is applied to the base of the transistor 124. The transistor 124 becomes conductive and draws the cathode of the SCR 120 toward the voltage level of the terminal 126. The SCR 120 is triggered into conduction, and the resistor 122 absorbs the voltage between terminals 32 and 126. The signal level at the gate of the triac 36 rises to the level of the terminal 32 because the SCR 120 is fully conductive, and turns on the triac 36. The triac 36 is commutated to the off or non-conductive condition when the applied AC waveform at terminals 32 and 34 transitions through the zero crossing point. The SCR 120 is commutated to the off or non-conductive condition when the signal 56 applied to the base of the transistor 124 is removed and the transistor 126 becomes non-conductive.

From the foregoing description, it is apparent that the fluorescent starter circuit embodiments of the present invention are automatically effective in lighting the fluorescent lamp by creating a high di/dt at the time preceding the zero crossing point of the applied AC current. Preferably, the high holding current characteristic of a triac or other semiconductor thyristor is advantageously employed for this purpose, because the high holding current thyristor inherently obtains this functionality at a relatively low cost. The inherent phase lag of the current which the ballast creates results in application of the high voltage start pulse to the cathodes of the fluorescent lamp at the most appropriate time when the voltage across the cathodes nears its peak, thereby enhancing ignition of the lamp. Thus the starters of the present invention advantageously make use of not only the high di/dt from the high holding current triac, but also the fact that the di/dt from the triac commutating to the non-conductive condition inherently occurs when the voltage of the applied AC waveform nears a peak value. Reliable ignition of the lamp is achieved on a very rapid basis.

Various additional functions obtained by turning the lamp off and on at predetermined times or in response to ambient light conditions or in response to other selected or programmed control conditions is possible by use of the improved starter. Furthermore, because the starter is formed by solid state components, the starter may be integrated or constructed as a hybrid circuit and incorporated in a small space within a conventional fluorescent lamp or lamp attachment assembly. Many other significant advantages and features of the present invention will be apparent after a full comprehension of the improved characteristics of the invention.

Presently preferred embodiments of the invention and its improvements have been described with a degree of particularity. This description has been made by way of preferred example. It should be understood that the scope of the present invention is defined by the following claims, and should not necessarily be limited by the detailed description of the preferred embodiment set forth above.

The invention claimed is:

1. A starter for use with a fluorescent lamp having cathodes connected in a series circuit with a ballast and energized by an alternating (AC) power source, said starter lighting the lamp by igniting a plasma which a voltage from each half cycle of the AC power thereafter sustains, said starter adapted to be connected to the cathodes, said starter comprising:

a conduction initiation circuit to selectively conduct current from the AC power source through the ballast and the cathodes commencing during one half cycle of applied AC current; and a conduction termination circuit to cease conducting current substantially instantaneously at a predetermined time during the one half cycle when the current is of a predetermined level to establish a sufficiently great change in current per change in time (di/dt) to generate a starting voltage pulse from the ballast between the cathodes sufficient to ignite the plasma, the predetermined time at which the di/dt creates the starting pulse being a time when the voltage of the AC power across the cathodes exceeds a predetermined ignition voltage of the plasma;

the conduction initiation circuit further comprising:

a sensing circuit adapted to be connected to the cathodes and operative to develop a first signal related to the voltage between the cathodes;

a reference circuit to supply a second signal related to a predetermined voltage at which the plasma ignites; and a trigger circuit including a comparator responsive to the first and second signals to control application of a trigger signal to initiate current conduction by the conduction initiation circuit and to terminate current conduction by the conduction termination circuit upon the first signal obtaining a predetermined relationship compared to the second signal.

2. A starter as defined in claim 1 wherein said starter is adapted to be connected substantially only to the cathodes of the fluorescent lamp.

3. A starter as defined in claim 1 wherein the conduction initiation circuit and the conduction termination circuit each include:

a thyristor which is gated on at the beginning of the one cycle of conducted current, which has a predetermined holding current at least equal to the predetermined level, and which is commutated off at the end of the one half cycle by a decrease in the current conducted from the power source to the holding current level of the thyristor near the end of the one half cycle.

4. A starter as defined in claim 1 wherein the conduction initiation circuit and the conduction termination circuit each comprise:

a thyristor which has a predetermined holding current at least equal to the predetermined level.

5. A starter as defined in claim 4 wherein:

the thyristor commutates off when the current conducted during the one half cycle decreases to the level of the predetermined holding current prior to a zero crossing of the conducted current between the one half cycle and the next subsequent half cycle of conducted current.

6. A starter as defined in claim 1 wherein the conduction termination circuit further comprises:

a blanking circuit connected to the trigger circuit and operative to selectively inhibit the trigger signal in response to the starting pulse occurring at the predetermined time of the di/dt.

7. A starter as defined in claim 6 wherein the conduction termination circuit further comprises:

a control circuit connected to the blanking circuit and operative to selectively inhibit the blanking circuit to extinguish the lamp by allowing the trigger signal occurring in response to the starting pulse to trigger the thyristor at the predetermined time of the di/dt and prevent the starting pulse from reaching a predetermined magnitude to ignite the plasma.

8. A starter as defined in claim 7 wherein:

the control circuit is further connected to the trigger circuit to selectively inhibit the application of trigger signals to the thyristor.

9. A starter as defined in claim 12 wherein:

the control circuit further controls the trigger and blanking circuits to selectively light the lamp during a predetermined number of cycles of applied AC power and extinguishes the lamp during a predetermined lesser number of cycles of applied AC power to modulate the light emitted from the lamp to a level less than the maximum amount of light emitted by lighting the lamp during all of the cycles of applied AC power.

10. A starter as defined in claim 8 wherein:

the control circuit further controls the trigger and blanking circuits to accomplish at least one of selectively lighting the lamp at a predetermined time or selectively extinguishing the lamp at a predetermined time.

11. A starter as defined in claim 8 wherein:

the control circuit is further connected to the cathodes and is programmable to selectively control the lighting of the lamp by predetermined power interruptions from the AC power source sensed at the cathodes.

12. A starter as defined in claim 1 wherein the conduction initiation circuit further comprises:

a time constant circuit which is connected to the cathodes and which derives a duration signal related to the time when the thyristor is triggered into conduction; and wherein:

the trigger circuit is further responsive to the duration signal for terminating the trigger signal at a predetermined time after the current conducted by the a thyristor has exceeded the predetermined holding value.

13. A starter as defined in claim 1 wherein the conduction initiation circuit and the conduction termination circuit further comprise:

a time constant circuit which is connected to the cathodes and which supplies and terminates the trigger signal, the time constant circuit supplying the trigger signal and maintaining the trigger signal until the current conducted by the thyristor has exceeded the predetermined holding current value during the one half cycle of conducted current.

14. A starter as defined in claim 13 wherein the time constant circuit comprises:

a capacitor, a resistor connected to charge the capacitor during a half cycle of AC power applied at the cathodes at a rate established by a time constant of the values of the capacitor and the resistor;

a unidirectional conductive device connected to the resistor and the capacitor and operative to direct current flowing in one direction through the resistor and to bypass current flowing in the opposite direction around the resistor, the current flowing in the one direction charges the capacitor and the current flowing in the other direction discharging the capacitor, the unidirectional conductive device creating one time constant for charging the capacitor and another time constant for discharging the capacitor; and wherein:

the capacitor is charged during a half cycle of applied current preceding the one half cycle when the thyristor is conductive; and the capacitor is discharged during the one half cycle of current when the trigger signal is applied to cause the thyristor to conduct.

15. A starter as defined in claim 14 wherein:

the time constant for charging the capacitor during the preceding half cycle is sufficient to charge the capacitor to create the trigger signal when the voltage between the cathodes is greater than the predetermined ignition voltage and is insufficient to charge the capacitor to create the trigger signal when the voltage between the cathodes is at the predetermined ignition voltage.

16. A starter as defined in claim 14 wherein:

the time constant for discharging the capacitor during the one half cycle is sufficient to maintain the thyristor conductive until the current conducted from the AC power source exceeds the predetermined holding current value.

17. A starter as defined in claim 13 wherein the time constant circuit comprises:

a capacitor, a resistor connected to charge the capacitor during a half cycle of AC power applied at the cathodes at a rate established by a time constant of the values of the capacitor and the resistor; and wherein:

the time constant for charging the capacitor is sufficient to charge the capacitor to create the trigger signal when the voltage between the cathodes is greater than the predetermined ignition voltage and is insufficient to charge the capacitor to create the trigger signal when the voltage between the cathodes is at the predetermined ignition voltage.

18. A starter as defined in claim 17 wherein:

the charged capacitor maintains the trigger signal for a time period sufficient for the current conducted by the thyristor to exceed the predetermined level.

19. A starter as defined in claim 18 wherein:

the time constant of the capacitor and resistor does not allow the capacitor to charge sufficiently in response to a starting pulse to create the trigger signal.

20. A starter as defined in claim 1 wherein the conduction initiation circuit further comprises:

a second thyristor in addition to the thyristor first aforesaid, the second thyristor connected to the first thyristor and responsive to the trigger signal to amplify the magnitude of current applied to initiate conduction from the first thyristor.

21. A starter for use with a fluorescent lamp having cathodes connected to a ballast in a circuit energized by an alternating (AC) power source, said starter lighting the lamp by igniting a plasma which a voltage from each half cycle of the AC power thereafter sustains, said starter comprising:

a pair of terminals adapted to connect to the cathodes;

a controllable semiconductor switch connected between the terminals and operative in response to a trigger signal to begin conducting current from the AC power source between the terminals and through the cathodes and to end conducting current substantially immediately when the current conducted by the switch decreases to a predetermined level;

a sensing circuit connected to the terminals and operative to develop a first signal related to the voltage applied between the terminals;

a reference circuit to supply a second signal related to the ignition voltage of the plasma within the lamp;

a trigger circuit responsive to the first and second signals to supply a trigger signal to the controllable switch when the voltage of the AC power applied between the cathodes exceeds the ignition voltage;

the substantially immediate end of current conduction occurs at a time when the current flow through the ballast from the AC power source nears a zero crossing point and the voltage across the cathodes from the applied AC power is in excess of the ignition voltage; and the predetermined level of current at which the switch ends conducting is sufficiently great and the substantially immediate time for the switch to cease conducting current is sufficiently small to establish a change in current per change in time characteristic (di/dt) which creates a voltage from the ballast between the cathodes sufficient to ignite a plasma in the lamp between the cathodes.

22. A method as defined in claim 21 further comprising the steps of:

sensing the voltage between the cathodes;

comparing the voltage sensed between the cathodes with a predetermined voltage at which the plasma ignites;

ceasing to trigger the thyristor so long as the voltage sensed does not exceed the predetermined ignition voltage.

23. A method as defined in claim 22 further comprising the step of:

inhibiting the gating of the thyristor in response to the starting pulse occurring at the time of the di/dt.

24. A method as defined in claim 22 further comprising the steps of:

selectively lighting the lamp during a predetermined number of cycles of applied AC power;

selectively extinguishing the lamp during a predetermined lesser number of cycles of applied AC power; and controlling the intensity of light emitted from the lamp by interspersing at least one cycle of extinguishing the lamp with a plurality of cycles of lighting the lamp.

25. A method as defined in claim 22 further comprising at least one of the steps of:

selectively lighting the lamp at a preprogrammed predetermined time; and selectively extinguishing the lamp at a preprogrammed predetermined time.

26. A method as defined in claim 22 further comprising the step of:

programmably selecting and thereby controlling the lighting and extinguishing of the lamp by applying predetermined power interruptions from the AC power source.

* * * * *